US008362967B2

(12) United States Patent
Foo et al.

(10) Patent No.: US 8,362,967 B2
(45) Date of Patent: Jan. 29, 2013

(54) LOW POWER MULTI-BEAM ACTIVE ARRAY FOR CELLULAR COMMUNICATIONS

(75) Inventors: Senglee Foo, Irvine, CA (US); Bill Vassilakis, Orange, CA (US); Alexander Rabinovich, Cypress, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 420 days.

(21) Appl. No.: 12/579,211

(22) Filed: Oct. 14, 2009

(65) Prior Publication Data

US 2010/0109965 A1 May 6, 2010

Related U.S. Application Data

(60) Provisional application No. 61/105,773, filed on Oct. 15, 2008.

(51) Int. Cl.
*H01Q 21/00* (2006.01)

(52) U.S. Cl. ..... 343/836; 343/700 MS; 343/844

(58) Field of Classification Search ..... 343/700 MS, 343/824, 844, 893, 836, 872, 873
See application file for complete search history.

(56) References Cited

U.S. PATENT DOCUMENTS 6,114,997 A * 9/2000 Lee et al. ..... 343/700 MS
7,403,172 B2 * 7/2008 Cheng ..... 343/853
7,817,096 B2 10/2010 Linehan

* cited by examiner

*Primary Examiner* — Dieu H Duong
(74) *Attorney, Agent, or Firm* — OC Patent Law Group

(57) ABSTRACT

An antenna architecture with enhanced emission directivity is disclosed. The antenna comprises a dielectric structure positioned over a plurality of radiator elements. The dielectric structure comprises columns of dielectric disks positioned above each radiator element. The antenna is driven by beam forming networks to form multiple, simultaneously steerable beams or a single main beam that can be dynamically steered.

20 Claims, 5 Drawing Sheets

LOW POWER MULTI-BEAM ACTIVE ARRAY FOR CELLULAR COMMUNICATIONS

RELATED APPLICATION INFORMATION

The present application claims priority under 35 USC Section 119(e) to U.S. provisional patent application Ser. No. 61/105,773 filed Oct. 15, 2008, the disclosure of which is incorporated herein by reference in its entirety.

BACKGROUND OF THE INVENTION

1. Field of the Invention

The present invention relates to radio communication antenna systems for wireless networks. More particularly, the invention is directed to active array antennas and related methods.

2. Description of the Prior Art and Related Background Information

Modern wireless antenna systems generally include a plurality of radiating elements that may be arranged over a ground plane defining a radiated (and received) signal beamwidth and azimuth angle. Antenna beamwidth has been conventionally defined by Half Power Beam Width ("HPBW") of the azimuth or elevation beam relative to a bore sight of such antenna element.

Real world applications often call for an antenna radiating element with frequency bandwidth, pattern beamwidth and polarization requirements that may not be possible for conventional antenna radiating element designs to achieve due to overall mechanical constraints.

Accordingly, a need exists for an improved antenna element architecture which allows enhanced directivity to improve the overall aperture efficiency of the antenna array.

SUMMARY OF THE INVENTION

In the first aspect, the present invention provides an antenna radiating structure comprising a reflector having first, second and third generally planar reflector panels. The first, second, and third columns of one or more radiator elements are coupled to the respective reflector panels. The second column of radiator elements is configured between the first and third columns of radiator elements. The antenna further comprises first, second, and third generally planar dielectric support sheets that are configured above the first, second, and third reflector panels. The antenna further comprises first, second, and third columns of dielectric disks coupled to the respective dielectric support sheets. The second column of dielectric disks is configured between the first and third columns of dielectric disks.

In a preferred embodiment of the antenna, the first and second columns of radiator elements are configured with their planar surfaces oriented at an angle $\alpha$ relative to that of the second column of radiator elements. The angle $\alpha$ of the planar surface of the first and third column of radiator elements relative to the angle of the second column of radiator elements is in the range of approximately 5 degrees to approximately 12 degrees. The angle $\alpha$ of the planar surface of the first and third column of radiator elements relative to the angle of the second column of radiator elements is preferably approximately 10 degrees. The distance between the first, second, and third columns of radiator elements and the first, second, and third columns of dielectric disks is in the range of approximately 0 millimeters to approximately 0.1 of the wavelength of the radiation. The radiator elements have a width and a height in the range of approximately 0.25 of the wavelength of the radiation to approximately 0.5 of the wavelength of the radiation. The radiator elements preferably have a width and a height of approximately 0.35 of the wavelength of the radiation. The height and the width of the dielectric disks are in the range of approximately 0.05 of the wavelength of the radiation to approximately 0.5 of the wavelength of the radiation. The distance between adjacent radiator elements along the length of the reflector is in the range of approximately 0.8 of the wavelength of the radiation. The distance between adjacent radiator elements along the width of the reflector is in the range of approximately 0.5 of the wavelength of the radiation to approximately 0.7 of the wavelength of the radiation. The antenna radiating structure may further comprise a fourth column of dielectric disks which is configured adjacent to and between the second and third columns of dielectric disks on the second dielectric support sheet. The antenna radiating structure may further comprise a beam forming network wherein the first, second and third column of radiating elements are coupled to the beam forming network.

In another aspect, the present invention provides an antenna radiating structure, comprising a reflector having one or more reflector panels. A plurality of radiator elements are coupled to the one or more reflector panels and configured in plural columns of plural radiator elements. The antenna further includes a plurality of dielectric disks configured above the radiator elements in a radiating direction and arranged in a plurality of columns.

In a preferred embodiment of the antenna further includes one or more dielectric support sheets, where the plurality of dielectric disks are coupled to the one or more dielectric support sheets. The one or more reflector panels preferably form a trapezoid in cross section. The one or more reflector panels may comprise a plurality of reflector panels, wherein each reflector panel is configured with its planar surface oriented at an angle relative to an adjacent reflector panel. The distance between the radiator elements and the dielectric disks preferably is in the range of approximately 0 millimeters to approximately 0.1 of the wavelength of the radiation.

In another aspect, the present invention provides a multi-beam antenna radiating structure having a reflector comprising one or more reflector panels. A first group of radiator elements are coupled to the one or more reflector panels and configured in plural columns of plural radiator elements. A second group of radiator elements are coupled to the one or more reflector panels and configured in plural columns of plural radiator elements. The antenna further includes a plurality of dielectric disks configured above the radiator elements in a radiating direction and arranged in a plurality of columns. The first group of radiator elements radiates a first emission beam and the second group of radiator elements radiates a second emission beam.

In a preferred embodiment, the first emission beam may have a different beam direction than the second emission beam. The first emission beam may have a different wavelength than the second emission beam.

Further features and aspects of the invention are set out in the following detailed description.

DETAILED DESCRIPTION OF THE INVENTION

It is an object of the present invention to enhance the directivity of a standard radiating patch antenna by employing a dielectric structure above a plurality of radiator elements. In an embodiment of the present invention, the dielectric structure comprises a plurality of dielectric disks that are positioned above each associated radiator element. These dielectric disks act to locally collimate the beam, which concentrates the transmitted signal and increases the gain of the antenna. As such, these high gain antennas can be driven by low power amplifiers that exhibit high linearity and efficiencies and are suitable for use in cellular communications.

The local beam collimation effect of the dielectric structure can be further enhanced by tailoring the shape of the reflector to optimize directivity, to reduce the scan losses, and to improve the overall EIRP performance. In an embodiment of the invention, a reflector having trapezoid shape is contemplated. This embodiment maintains high directivity at a zero scan angle, yet reduces scan loss significantly at higher angles by taking advantage of aperture enhancement at the edge columns.

In an embodiment of the present invention, the antenna radiating structure employs N by N transmitters and receivers. This allows the implementation of average digital predistortion linearization, in which non-linearity of the power amplifiers are characterized and compensated on the mean-value basis for each column. As a result, this architecture allows design of low-cost active array of reasonable aperture size using distributed low power amplifiers with high linearity and efficiency suitable for use in cellular communications.

Figure 1:
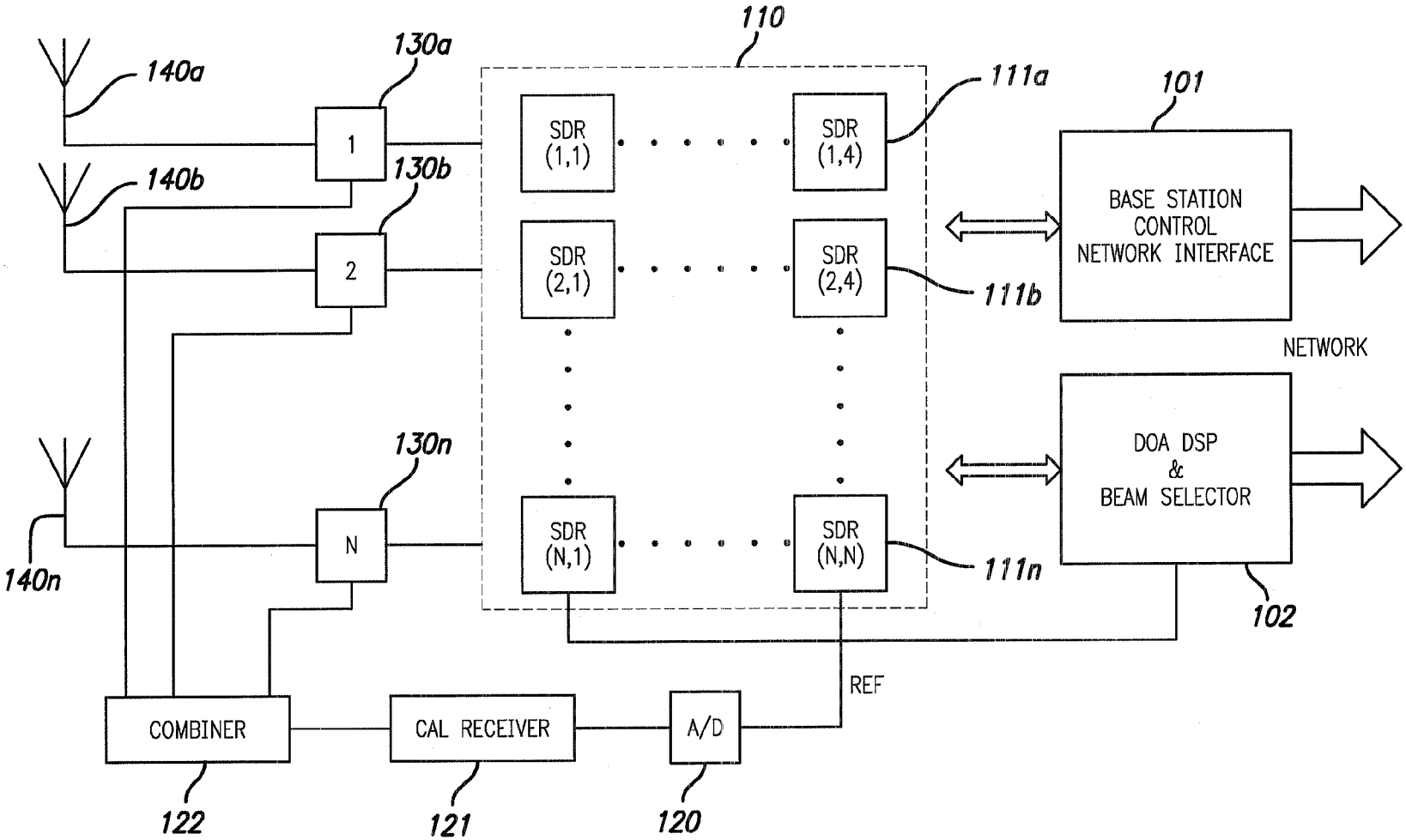
FIG. 1 is a system block diagram of a low power active antenna array in accordance with an embodiment of the present invention.

FIG. 1 is a system block diagram of a low power active array in accordance with an embodiment of the present invention. In an embodiment of the present application, a plurality of software defined radios (SDR's) 111*a*-111*n* are combined to form a digital beam forming network (BFN) 110 having N×N radios. These SDRs are controlled through a network via the Base Station Control Network Interface 101. Such a beam forming array allows to form multiple, simultaneously steerable beams. Each beam (1-N) can be configured to have high gain and good sidelobe suppression while effectively controlling half power beamwidth (HPBW) of the beam. Use of SDRs 111*a*-111*n* coupled with the Direction of Arrival (DOA) of all the received signals, including interfering signals and the multipath signals, can be processed using known Direction of Arrival Algorithms with DSP techniques in circuit block 102. DSP implementation allows use of adaptive beam forming techniques or weight functions, providing dynamic array pattern optimization. In case of a single beam scanning, a single main beam can be dynamically steered. Additionally, adaptive beamforming techniques can effectively reject or minimize interfering signals having a direction of arrival different from that of a desired signal. Similarly cross-polarized multi dimensional antenna arrays can also reject interfering signals having different polarization from the desired signals. This processing may also be implemented in block 102.

The outputs of the SDRs in the BFN 110 are electrically coupled to low power amplification modules 130*a*-130*n*. In an embodiment of the present invention, the low power amplification modules 130*a*-130*n* exhibit high linearity and high efficiency and are suitable for use in cellular communications. The outputs of the low power amplification modules 130*a*-130*n* are electrically coupled to antennas 140*a*-140*n*. In an embodiment of the present invention, antennas 140*a*-140*n* operate bi-directionally and also receive incoming signals that are provided to the BFN 110. The received signals are routed to low power amplification modules 130*a*-130*n* and also to the combiner 112. The output of combiner 122 is electrically coupled to calibration receiver 121, where the output of calibration receiver 121 is electrically coupled to the analog to digital converter ("A/D") 120. The output of A/D converter 120 is fed back into the BFN 110 for use as a reference signal.

Figure 2A:
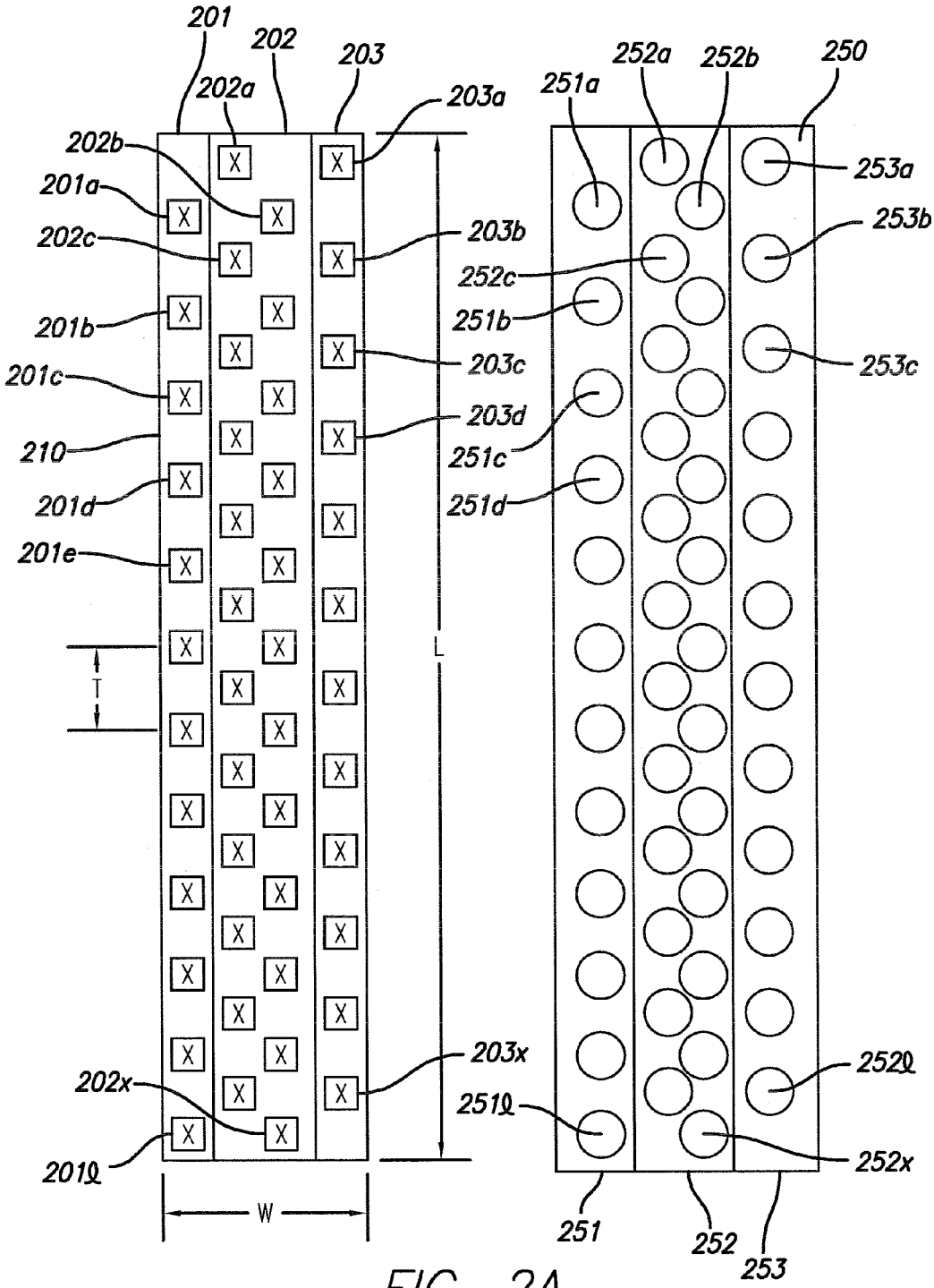
FIG. 2A is a top view of a multi-column array with directivity enhancement using a dielectric structure in one or more embodiments of the invention.
Figure 2B:
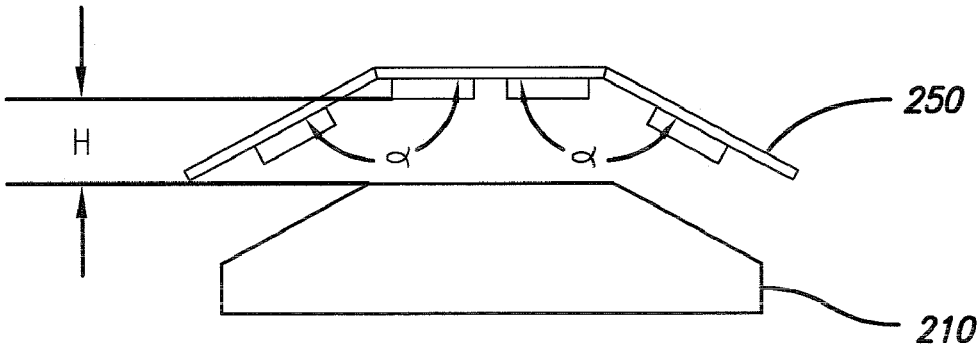
FIG. 2B is a cross-section of the apparatus depicted in FIG. 2A in an embodiment of the invention.

FIG. 2A is a top view of a multi-column array with directivity enhancement using dielectric structure in one or more embodiments of the invention and FIG. 2B illustrates a cross-section of the apparatus. In an embodiment of the present invention, the antenna structure comprises a reflector 210 and a dielectric structure 250. In a nonlimiting embodiment of the present invention, the length "L" is approximately 1650 millimeters and the width is approximately 350 millimeters.

In an embodiment of the present invention, reflector 210 is a conductive ground plane that can be fabricated from any conductive material. Reflector 210 may be fabricated from an Aluminum sheet in a preferred embodiment. Reflector 210 comprises a first reflector panel 201, a second reflector panel 202, and a third reflector panel 203. A first column of radiator elements 201*a*-201*l* are coupled to first reflector panel 201, a second column of radiator elements 202*a*-202*x* are coupled to the second reflector panel 202, and a third column of radiator elements 203*a*-203*l* are coupled to the third reflector panel 203. The length and width of the radiator elements 201*a*-201*l*, 202*a*-202*x*, and 203*a*-203*l* are in the range of approximately 0.25λ to approximately 0.50λ, where λ is the wavelength of the radiation. In a preferred embodiment, the length and width of the radiator elements is approximately 0.35λ. The distance between the radiator elements (201*a*-201*l*, 202*a*-202*x*, and 203*a*-203*l*) and their respective reflector panels 201-203 is in the range of approximately 0.05λ to approximately 0.20λ. The distance between adjacent radiator elements is approximately 0.8λ along the length of the reflector 210 and in the range of approximately 0.5λ to approximately 0.7 λ along the width of the reflector 210.

Dielectric structure 250 may comprise a first dielectric sheet 251, a second dielectric sheet 252, and a third dielectric sheet 253 that is positioned above reflector 210. A first column of dielectric disks 251*a*-251*l* is coupled to the first dielectric sheet 251, a second column of dielectric disks 252*a*-252*x*, is coupled to the second dielectric sheet 252, and a third column of dielectric disks 253*a*-253*a*-253*l* is coupled to the third dielectric sheet 253. The dielectric disks 251*a*-251*l*, 252*a*-252*x*, and 253*a*-253*l* have a thickness in excess of 0.05λ and may have a diameter of approximately 0.5λ. In an embodiment of the invention, the dielectric structure 250 may be fabricated with a low loss dielectric such as polypropylene or an Ultem type of material for example. In an embodiment of the invention, the dielectric disks 251*a*-251*l*, 252*a*-252*x*, and 253*a*-253*l*, may be fabricated through an injection molding process for low cost fabrication.

As depicted in FIG. 2A, in an embodiment of the invention, the first (201*a*-201*j*) and third (203*a*-203*j*) columns of radiator elements may be configured with their planar surfaces oriented at an angle a relative to that of the second column of radiator elements (202*a*-202*x*). The first (251*a*-251*j*) and third (253*a*-253*j*) columns of dielectric disks may be configured with their planar surfaces oriented at an angle α relative to that of the second column of radiator elements (252*a*-252*x*).

The distance between the dielectric structure 250 and reflector 210 (i.e., "H" in FIG. 2B) is in the range of approximately 0 (i.e., the dielectric structure 250 is in contact with reflector 210) to approximately 0.1λ. Each of the dielectric disks (251*a*-251*j*, 252*a*-252*x*, and 253*a*-253*j*) may be positioned approximately above each of the corresponding radiator elements 201*a*-201*j*, 202*a*-202*x*, and 203*a*-203*j* to provide local beam collimation.

Figure 3:
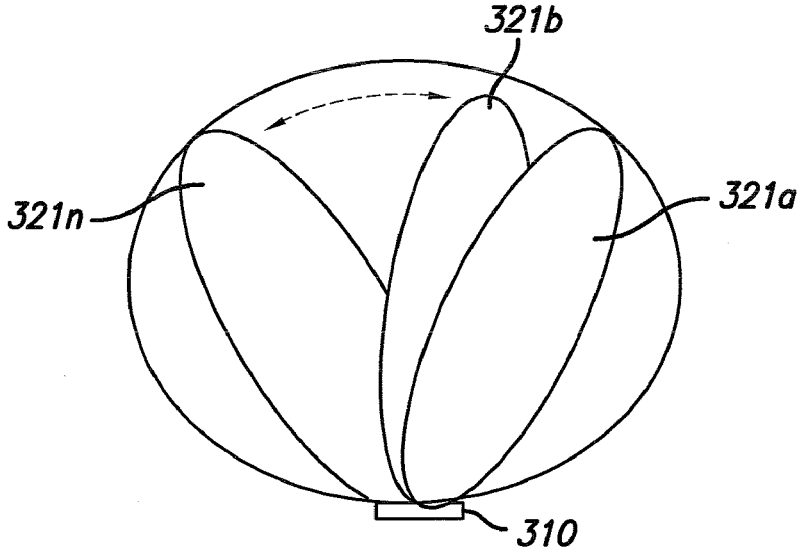
FIG. 3 is a representation of simulated antenna radiation patterns illustrating the emission of multiple beams for TDD and FDD multi-users voice and data communication applications in accordance with an embodiment of the present invention.

FIG. 3 is a representation of simulated antenna radiation patterns illustrating the emission of multiple beams for TDD & FDD multi-users voice and data communication applications in accordance with an embodiment of the present invention. In an embodiment of the invention, the beam forming array depicted in FIG. 1 represented in FIG. 3 as antenna 310 may be coupled to the radiator elements depicted in FIG. 2A to form multiple, simultaneously steerable beams 321*a*-321*n*. Each beam (1-N) can be configured to have high gain and good sidelobe suppression while effectively controlling half power beamwidth (HPBW) of the beam. In case of a single beam scanning, a single main beam can be dynamically steered. Additionally, adaptive beamforming techniques can effectively reject or minimize interfering signals having a direction of arrival different from that of a desired signal. Similarly cross-polarized multi dimensional antenna arrays can also reject interfering signals having different polarization from the desired signals.

An embodiment of the invention makes use of a relatively high gain antenna to minimize the total transmit power by using multicolumn array and baseband processing. For TDD applications, implementation may preferably be as follows. Each user is tracked and processed at baseband frequency. Array parameters for each user are computed based on adaptive array analysis and applied to the array at appropriate time slots. As a result, the array parameter can be a periodic varying function of time. The transmit signal is, therefore, concentrated and beamed toward each user at near maximum efficiency.

The preferred approach is somewhat more complicated for FDD applications. In this case, signals may be frequency or code modulated and then transmitted simultaneously in time. Therefore, it will no longer be feasible to apply the simple adaptive array method, because energy cannot be concentrated and beamed toward each user at the same time.

Figure 5:
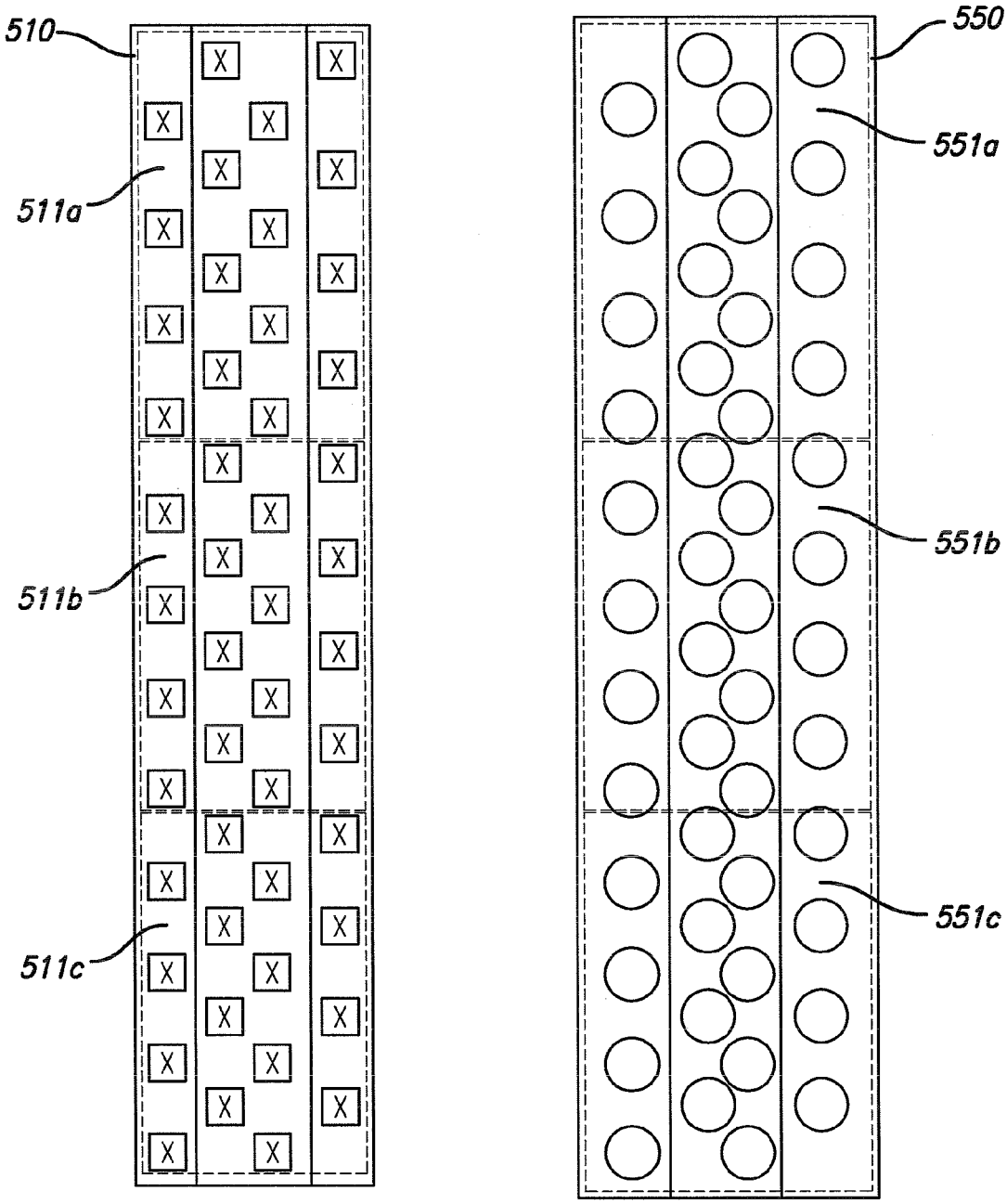
FIG. 5 is a top view of a multi-column array with directivity enhancement using a dielectric structure where the array is partitioned into separate groups.

A first embodiment employs a simultaneous multi-beam array. FIG. 5 is a top view of a multi-column array with directivity enhancement using a dielectric structure where the array is partitioned into separate groups. The antenna structure comprises a reflector 510 and a dielectric structure 550. Reflector 510 comprises a first group of radiator elements 511*a*, a second group of radiator elements 511*b*, and a third group of radiator elements 511*c*. The first, second, and third groups of radiator elements 511*a*-511*c* are coupled to reflector 510. Dielectric structure 550 comprises a dielectric supporting sheet on which a first group of dielectric disks 551*a*, a second group of dielectric disks 551*b*, and a third group of dielectric disks 551*c* are coupled. The distance between the dielectric structure 550 and reflector 510 is in the range of approximately 0 to approximately 0.1λ. In an embodiment where the dielectric disks are in contact with the radiator elements, a dielectric supporting sheet may not be required.

In an embodiment of the present invention, the first group of radiator elements 511*a* may radiate a beam emission pattern that differs from that of second group of radiator elements 511*b* or the third group of radiator elements 511*c* for example. In an embodiment of the present invention, the first group of radiators elements may generate an emission beam having a different emission wavelength for example. Such a multi-beam antenna structure may enable the emission beams to be frequency and code modulated.

In an embodiment of the present invention, a fixed numbers of beams will be generated by using RF beam formers. Boresight angles of each beam will be adjusted based on locations of the users. Each user will be tracked and pre-assigned to a pre-determined beam group (beam). Each group will then be frequency or code modulated separately and transmitted through the appropriate beam port simultaneously. The simulated emission patterns of a multi-beam antenna structure are depicted in FIG. 3. This approach requires a beam selection and hand-over for each user and is slightly more complicated in comparison to the TDD case. The method is also operating at a slightly less optimum performance in comparison to the TDD adaptive array approach because of the limited number of available beams in practice. However, this deficiency can be somewhat compensated by using an adjustable beam former, which allows some degree of beam peak optimization. Note that the same pilot signal can also be illuminated in all beams.

One important parameter is the overall EIRP. Conventional methods typically use a single column array with a relatively high RF transmit power. This method has a relatively low efficiency and high power dissipation. The disclosed active array approach of the invention provides the same EIRP using a large number of transmitters with much lower transmit power at higher efficiency. This is achieved by taking advantage of incoherent power combining of the sideband noise of distributed architecture and the use of a more directive antenna.

Figure 4:
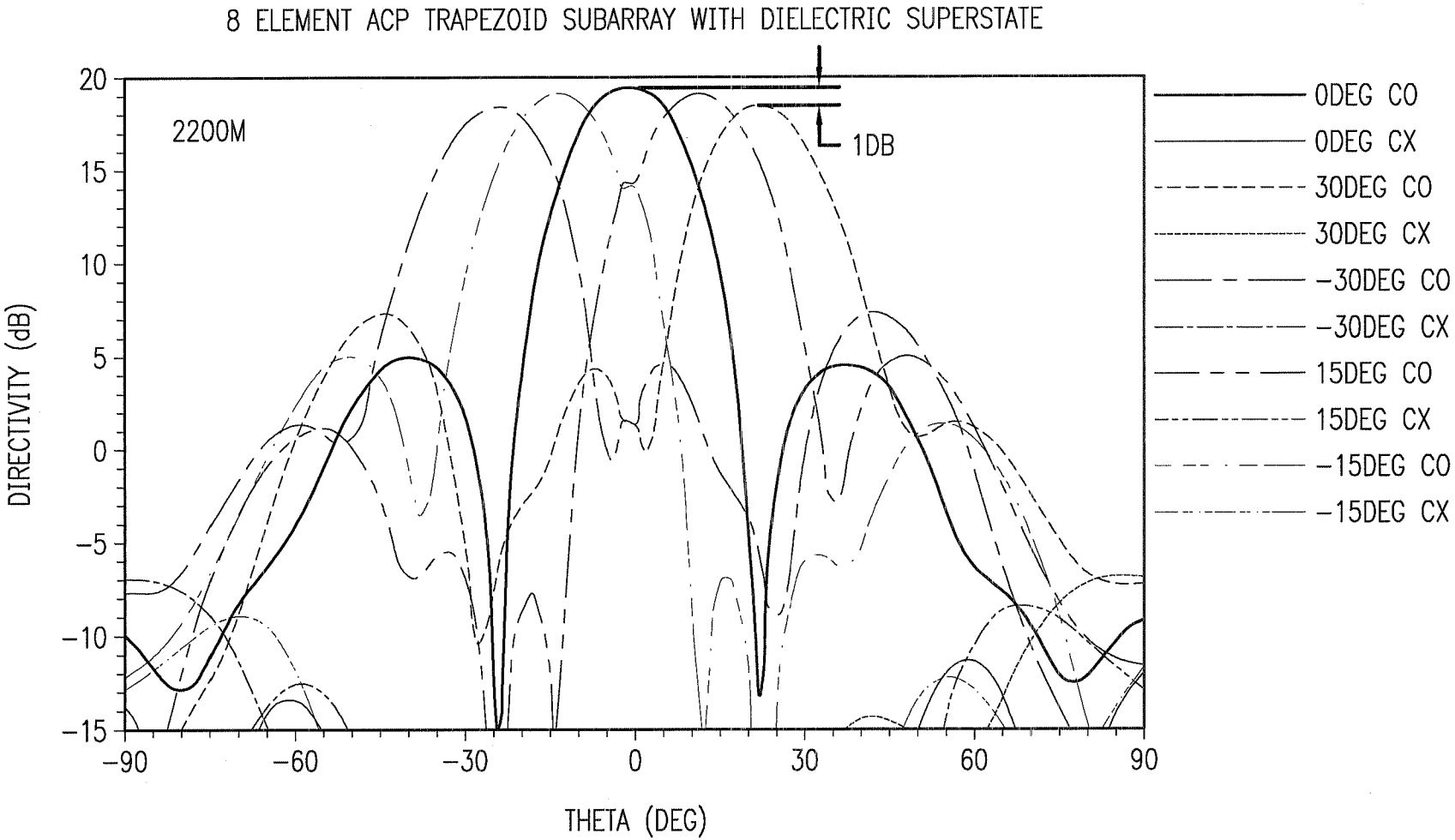
FIG. 4 is a representation of simulated antenna radiation patterns for a multi-column array with a gain-enhancement dielectric structure in an embodiment of the invention.

FIG. 4 is a representation of simulated antenna radiation patterns for a multi-column array with a gain-enhancement dielectric structure in an embodiment of the invention that illustrates that the dielectric structure improves the directivity of the emitted radiation.

The present invention has been described primarily for enhancing the directivity of radiator elements through the use of a dielectric structure above radiator elements. In this regard, the foregoing description of an antenna element based on the dielectric structure is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna radiating structure, comprising:

a reflector comprising first, second, and third generally planar reflector panels;

first, second, and third generally planar dielectric support sheets, each configured above each of the first, second, and third reflector panels;

first, second, and third columns of two or more radiator elements coupled to the respective first, second and third dielectric sheets, wherein the second column of radiator elements is configured between the first and third columns of radiator elements; and first, second, and third columns of dielectric disks, each of said dielectric disks above each of said radiator elements and coupled to the respective dielectric support sheet, wherein the second column of dielectric disks is configured between the first and third columns of dielectric disks;

wherein the plurality of the dielectric disks provide enhanced control of beam radiation patterns.

2. The antenna radiating structure as set out in claim 1, wherein the first and second column of radiator elements are configured with their planar surfaces oriented at an angle $\alpha$ opposite to the radiating direction relative to that of the second column of radiator elements.

3. The antenna radiating structure as set out in claim 2, wherein the angle $\alpha$ of the planar surface of the first and third column of radiator elements relative to the angle of the second column of radiator elements is in the range of approximately 5 degrees to approximately 12 degrees.

4. The antenna radiating structure as set out in claim 2, wherein the angle $\alpha$ of the planar surface of the first and third column of radiator elements relative to the angle of the second column of radiator elements is approximately 10 degrees.

5. The antenna radiating structure as set out in claim 2, wherein the distance between the first, second, and third columns of radiator elements and the first, second, and third columns of dielectric disks is in the range of approximately 0 millimeters to approximately 0.1 of the wavelength of the radiation.

6. The antenna radiating structure as set out in claim 2, wherein the radiator elements have a width and a height in the range of approximately 0.25 of the wavelength of the radiation to approximately 0.5 of the wavelength of the radiation.

7. The antenna radiating structure as set out in claim 2, wherein the radiator elements have a width and a height of approximately 0.35 of the wavelength of the radiation.

8. The antenna radiating structure as set out in claim 2, wherein the height and the width of the dielectric disks is in the range of approximately 0.05 of the wavelength of the radiation to approximately 0.5 of the wavelength of the radiation.

9. The antenna radiating structure as set out in claim 2, wherein the distance between adjacent radiator elements along the length of the reflector is approximately 0.8 of the wavelength of the radiation.

10. The antenna radiating structure as set out in claim 2, wherein the distance between adjacent radiator elements along the width of the reflector is in the range of approximately 0.5 of the wavelength of the radiation to approximately 0.7 of the wavelength of the radiation.

11. The antenna radiating structure as set out in claim 1, further comprising a fourth column of dielectric disks which is configured adjacent to and between the second and third columns of dielectric disks on the second dielectric support sheet.

12. The antenna radiating structure as set out in claim 7, further comprising a beam forming network wherein the first, second and third column of radiating elements are coupled to the beam forming network.

13. An antenna radiating structure, comprising:

a reflector comprising one or more reflector panels;

a dielectric planar support sheet on each of the one or more reflector panels, a plurality of radiator elements coupled to each of the one or more reflector panels and configured in plural columns of the plural radiator elements; and a plurality of dielectric disks, each of the plurality of dielectric disks configured above each of the radiator elements in a radiating direction and arranged in a plurality of columns of the radiator elements;

wherein the plurality of the dielectric disks provide enhanced control of beam radiation patterns.

14. The antenna radiating structure as set out in claim 13, further comprising oneor more dielectric support sheets, wherein the plurality of dielectric disks are coupled to the one or more dielectric support sheets.

15. The antenna radiating structure as set out in claim 14, wherein the one or more reflector panels form a trapezoid in cross section.

16. The antenna radiating structure as set out in claim 14, wherein the one or more reflector panels comprises a plurality of reflector panels, wherein each reflector panel is configured with its planar surface oriented at an angle opposite to the radiating direction relative to an adjacent reflector panel.

17. The antenna radiating structure as set out in claim 14, wherein the distance between the radiator elements and the dielectric disks is in the range of approximately 0 millimeters to approximately 0.1 of the wavelength of the radiation.

18. A multi-beam antenna radiating structure, comprising:

a reflector comprising one or more reflector panels;

a dielectric planar support sheet on each of the one or more reflector panels;

a first group of radiator elements coupled to first reflector panel of the one or more reflector panels and configured in plural columns of plural radiator elements;

a second group of radiator elements coupled to second reflector panel of the one or more reflector panels and configured in plural columns of plural radiator elements; and a plurality of dielectric disks, each of the plurality of the dielectric disks configured above each of the radiator elements in a radiating direction and arranged in a plurality of columns;

wherein the first group of radiator elements radiates a first emission beam and the second group of radiator elements radiates a second emission beam;

wherein the plurality of the dielectric disks provide enhanced control of beam radiation patterns.

19. The multi-beam antenna radiating structure as set out in claim 18, wherein the first emission beam has a different beam direction than the second emission beam.

20. The multi-beam antenna radiating structure as set out in claim 19, wherein the first emission beam has a different wavelength than the second emission beam.

* * * * *